United States Patent [19]

Jacobs

[11] Patent Number: 4,778,400

[45] Date of Patent: Oct. 18, 1988

[54] REMOTE ELECTRICAL CONNECTOR

[76] Inventor: Ray T. Jacobs, Rte. 3, Box 47, Idaho Falls, Id. 83401

[21] Appl. No.: 769,942

[22] Filed: Aug. 27, 1985

Related U.S. Application Data

[63] Continuation-in-part of Ser. No. 676,175, Nov. 29, 1984, abandoned.

[51] Int. Cl.[4] ..... H01R 13/62

[52] U.S. Cl. ..... 439/152; 439/271; 439/374

[58] Field of Search ..... 339/45, 46, 75 R, 75 M, 339/75 P, 91 R, 60 M, 94 R, 94 M, 119 R, 120, 125 R, 92

[56] References Cited

U.S. PATENT DOCUMENTS

| | | | |
|---|---|---|---|
| 2,177,756 | 10/1939 | Valkenburg | 339/120 |
| 2,466,370 | 4/1949 | Burtt | 339/45 M |
| 2,735,965 | 2/1956 | Balanda | 339/45 M |
| 3,513,478 | 5/1970 | Kemper et al. | 339/125 R |
| 3,784,959 | 1/1974 | Horton | 339/60 M |
| 3,888,559 | 6/1975 | Geib | 339/94 M |
| 4,050,767 | 9/1977 | Berning | 339/45 M |
| 4,166,664 | 9/1979 | Herrmann, Jr. | 339/60 M |
| 4,178,060 | 12/1979 | Coffey | 339/125 R |
| 4,217,030 | 8/1980 | Howarch | 339/45 M |
| 4,527,849 | 7/1985 | Marach | 339/125 R |

FOREIGN PATENT DOCUMENTS

| | | | |
|---|---|---|---|
| 2391573 | 1/1979 | France | 339/125 R |
| 2055255A | 11/1979 | United Kingdom . | |

OTHER PUBLICATIONS

Picture #1 Gulton Connector
Picture #2 Gulton Connector
Picture #3 Gulton Connector
Picture #4 Gulton Connector—News Release
Picture #5 Gulton Connector

*Primary Examiner*—Gil Weidenfeld
*Assistant Examiner*—David Pirlot
*Attorney, Agent, or Firm*—Fitch, Even, Tabin & Flannery

[57] ABSTRACT

The invention relates to a remote electrical connector which is particularly adapted for use in hostile environments, such as nuclear reactor plants. The connector comprises a static assembly and a removable assembly which can be connected and disconnected by means of a remotely-operated hook. One of the assemblies is provided with a guide rail at the bottom thereof which extends forwardly from the assembly, while the other assembly has a glide at the bottom thereof for sliding on the rail during connection or disconnection of the assemblies. The static assembly includes a male receptacle mounted thereon and a first cylindrical section which surrounds the receptacle. The removable assembly has a female socket mounted thereon with a second cylindrical section surrounding the female socket. The second cylindrical section is proportioned to fit within the first cylindrical section and is provided with a particular sealing ring for sealing and aligning with the first cylindrical section. The male receptacle and female socket are positioned to interengage one another and the assembly which slides on the rail is provided with a lanyard for disconnecting the electrical connector. The electrical connector is further protected against seismic shocks and explosions from movement in the horizontal and vertical directions by means of locking means. Top covers are provided for the assemblies to protect against contamination.

17 Claims, 4 Drawing Sheets

FIG. 1
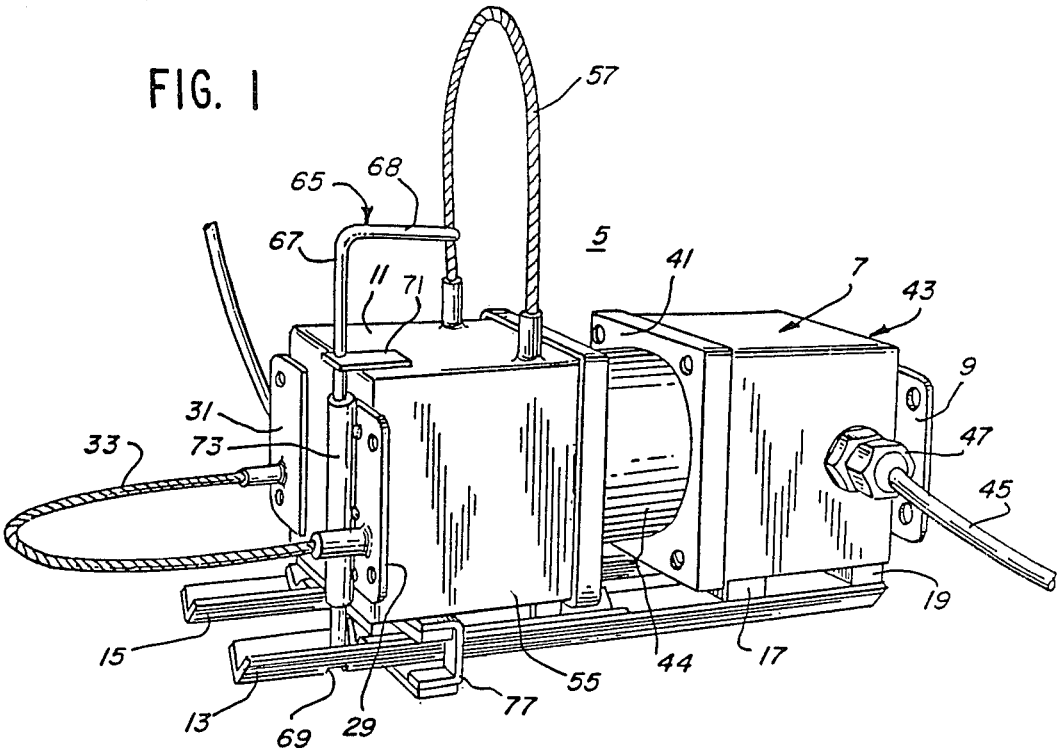
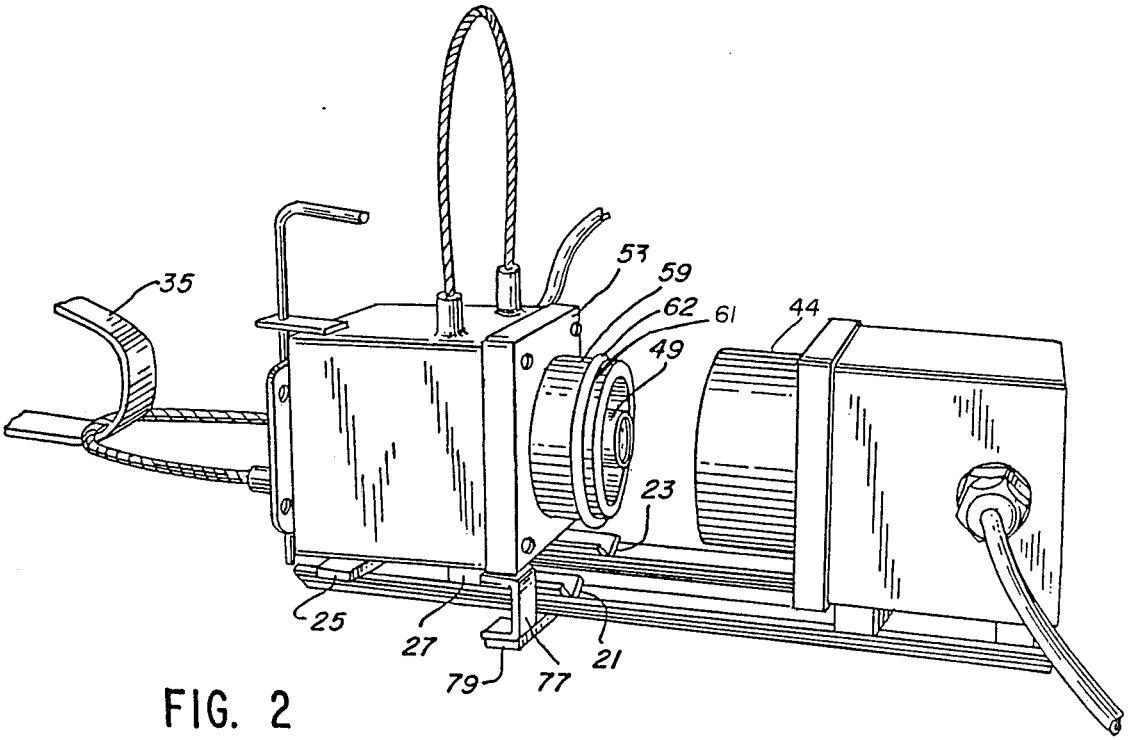
FIG. 2

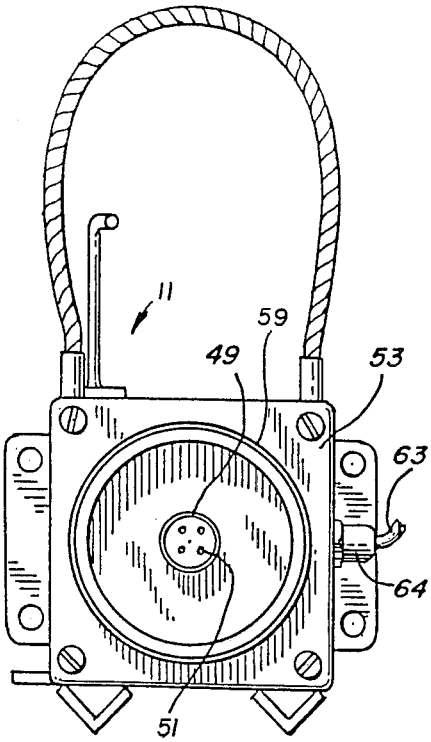
FIG. 3
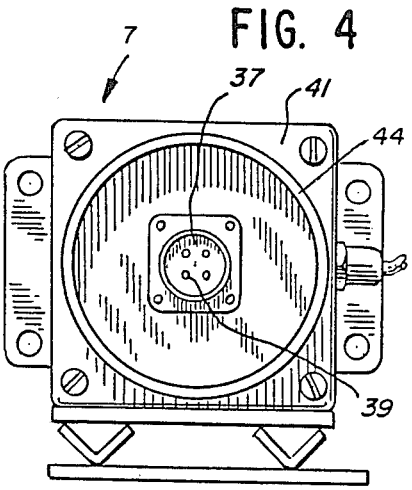
FIG. 4
FIG. 5
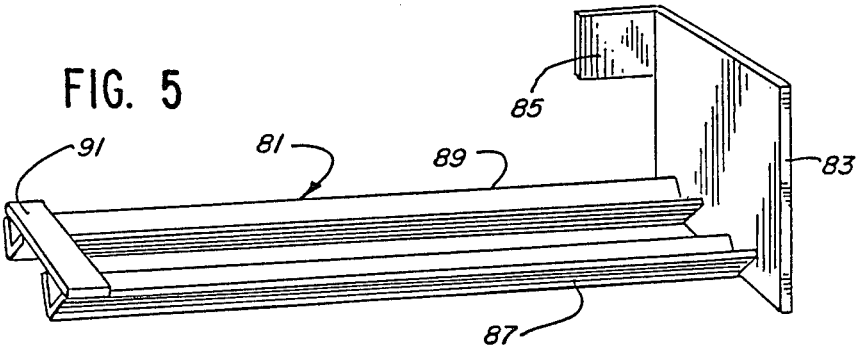
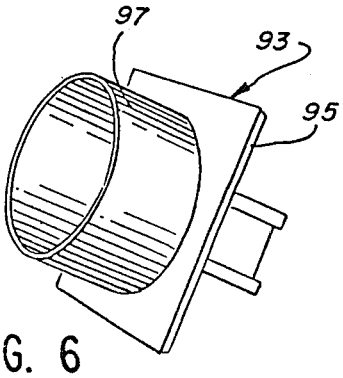
FIG. 6
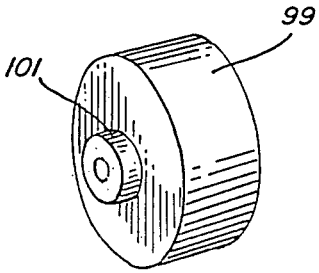
FIG. 7
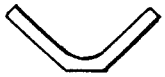
FIG. 8

FIG. 9
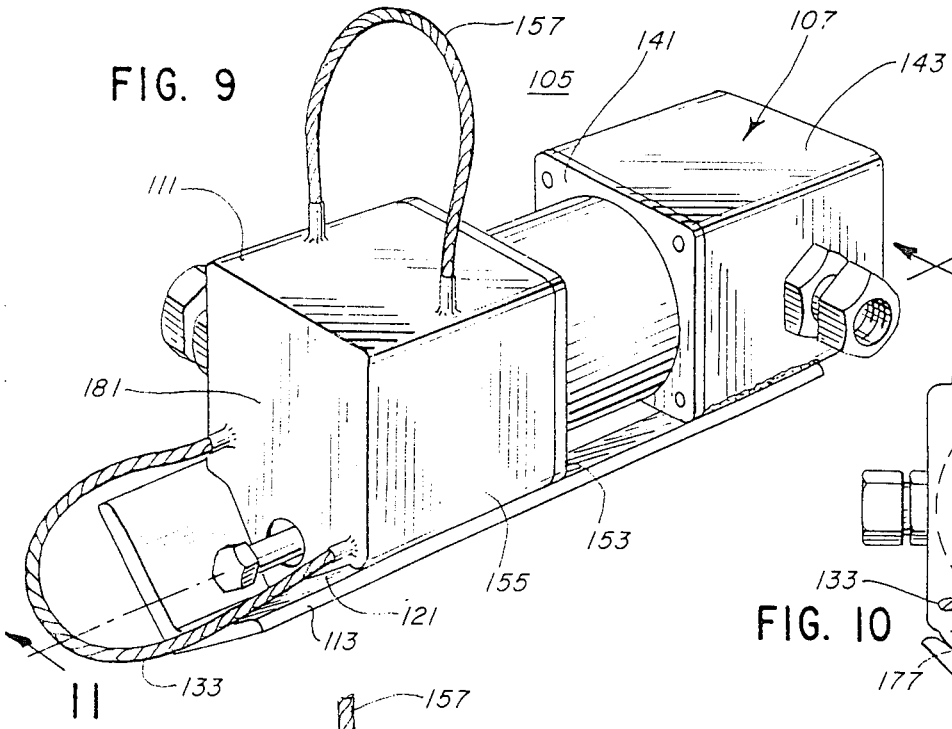
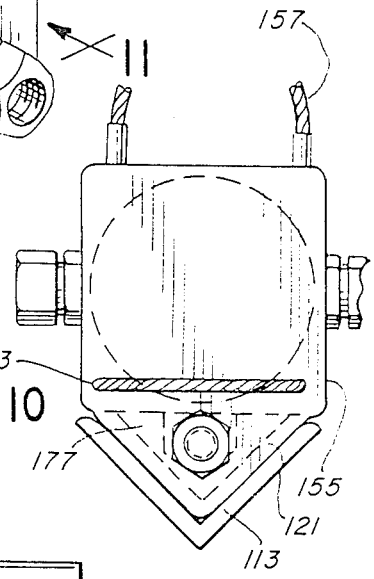
FIG. 10
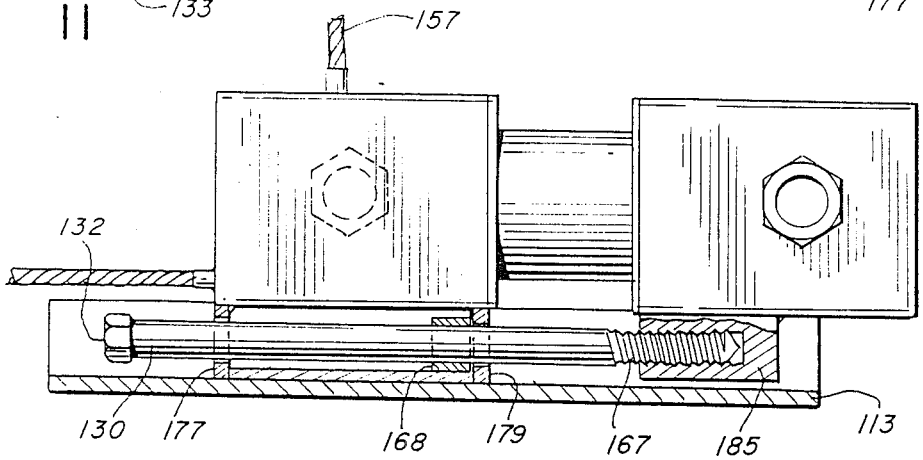
FIG. 11
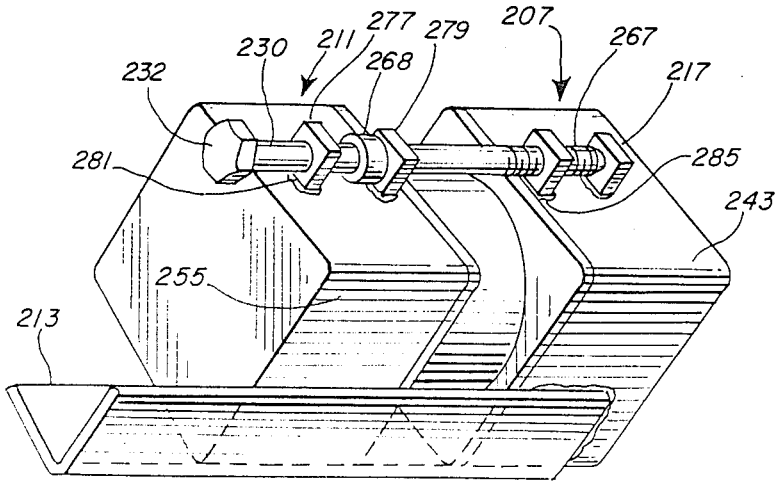
FIG. 12
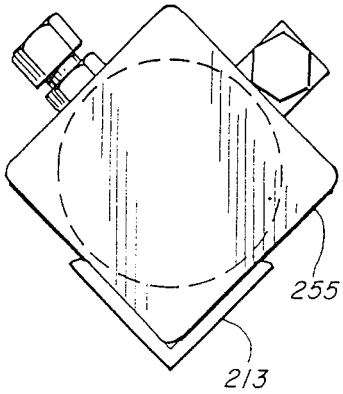
FIG. 13

FIG. 14
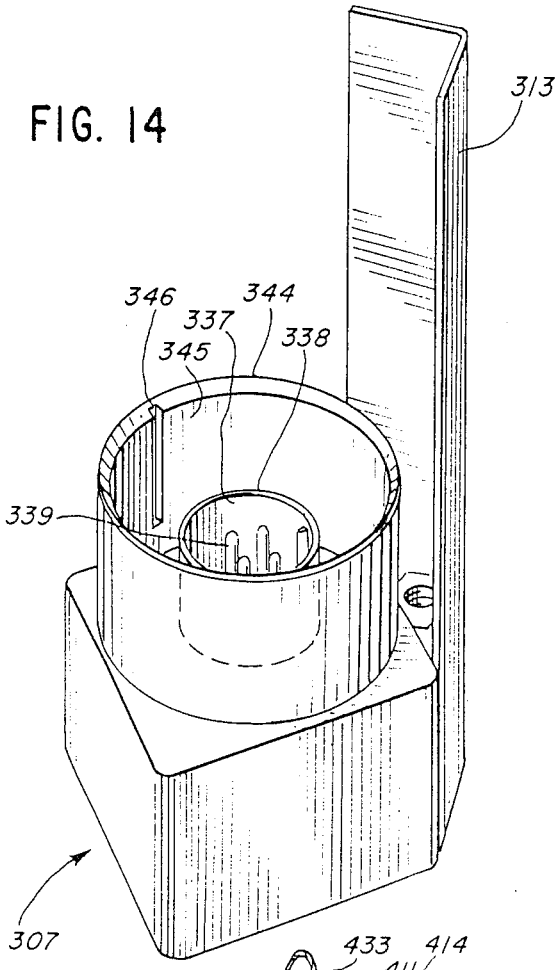
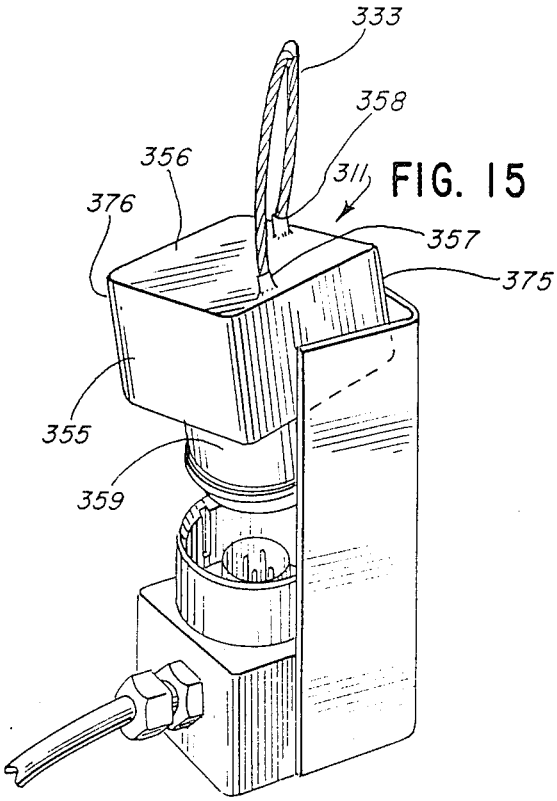
FIG. 15
FIG. 16
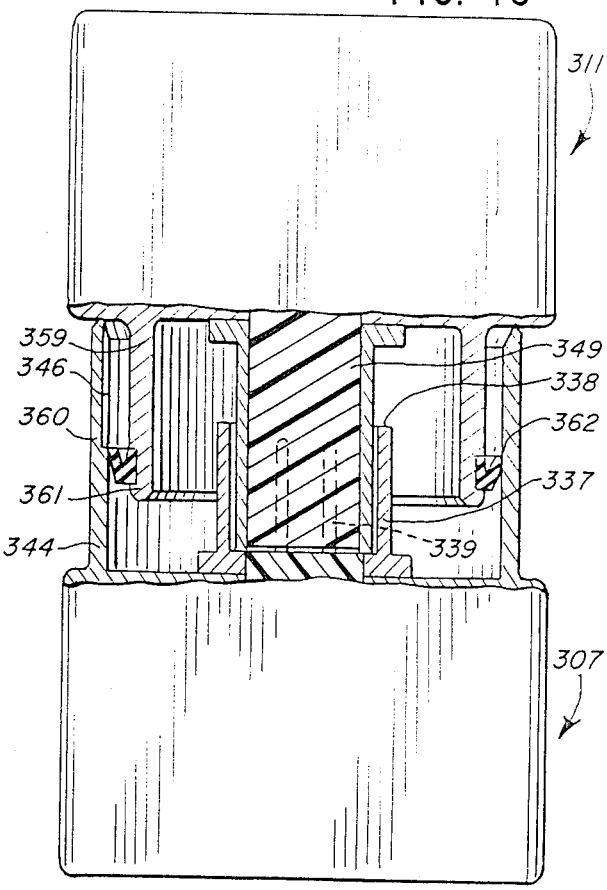
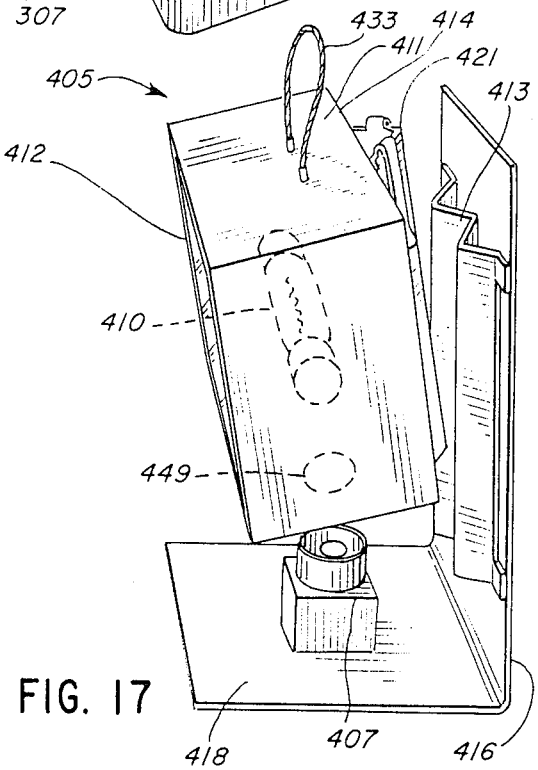
FIG. 17

REMOTE ELECTRICAL CONNECTOR

This is a continuation-in-part application of U.S. application Ser. No. 676,175 filed Nov. 29, 1984, now abandoned.

BACKGROUND OF INVENTION

Field of Invention

The present invention relates generally to an electrical connector, and more particularly, it relates to an electrical connector which can be remotely disconnected.

Electrical connectors are well known in the art and are adapted to connect two plugs together for conducting electricity. In connection with various activities, it is necessary to connect electrical connectors without human intervention, and this is particularly the case in connection with electrical connectors in nuclear fuel processing plants where electrically operated devices such as motors, lights and valves operate in a hostile environment. In many parts of nuclear plants there are such high levels of radiation that personnel cannot be allowed to be inside the processing areas. Accordingly, it is necessary for any repair and/or maintenance to be done on faulty equipment in such areas to be disconnected and removed in order to effect desired repair and/or maintenance.

In general, remote manipulators can only work with one hand and can transmit no sense of feel back to the operator. Accordingly, it has been necessary to develop special electrical connectors for electrical equipment so that they can be effectively and efficiently disconnected with one-hand remote manipulators.

The electrical connectors need to be in two parts so that one part can remain permanently in a dangerous area and, in the case of nuclear reactors, this is referred to as a radioactively "hot" area. The other part is removable with the device or mechanism to which it is attached. The electrical connectors should also be able to withstand the harsh environments of acid sprays and fumes which are routinely present in nuclear reactors. While this invention has particular application to hot areas, it is applicable in other hostile environments.

One electrical connector of the type of this invention is known to the art, and is identified as the LORMEC electrical connector, LORMEC being an acronym for lanyard-operated remote manipulator electrical connector. This known connector is specifically designed to be used with standard "hand-hook" attachments provided by remote manipulator systems, in which the lowest possible disconnect forces are required. However, this presently known electrical connector for remote operation has a number of disadvantages. First, the presently available remotely-operated electrical connector is expensive. Second, the plugs which are connected have a tendency to bind when being disengaged, thereby requiring significant disconnect forces. Third, the presently available remotely-operated electrical connectors do not include protection against such disengaging forces as explosions and earthquakes in both a horizontal and vertical direction, which disconnecting forces can adversely affect the operations of the plants. Fourth, the presently available remotely-operated electrical connector is more difficult to assemble and requires special custom made machined parts.

There is a substantial need for a remotely-operated electrical connector which is low in cost and does not bind upon connection or disconnection. It is desired that the remotely-operated electrical connector be readily fabricated and easily disconnected by a limited amount of force. Further, it is important that the electrical connector be protected against seismic shock by appropriate locking mechanisms. Also, it is important that protection be provided for the connector by means of a remote manipulator, so that corrosive decontamination sprays and the like cannot come into contact with the electrical innards of the connector while in the disengaged mode.

Finally, it is important that the remotely operated connector easily engage and disengage when positioned horizontally as well as vertically. In this regard when the connectors are to be engaged from the vertical, the weight and the disposition of the assembly should permit it to be remotely operated, positioned and readily connected.

Accordingly, it is a principal object of the present invention to provide an improved, remotely-operated electrical connector. Another object of the invention is to provide a much less costly remotely-operated electrical connector. It is a further object of the invention to provide an electrical connector which can be remotely operated and which does not bind and which can be disconnected with minimum force from the vertical and/or the horizontal, but still have an appropriate locking mechanism. A still further object of this invention is the provision of a remotely-operated electrical connector which can be readily and simply fabricated from available parts at low cost. Various other features of the invention will be apparent from the following drawings and description.

DRAWINGS

In the drawings:

FIG. 1 is a perspective view of the electrical connector of the invention in assembled relation;

FIG. 2 is also a perspective view of the electrical connector of the invention, showing the connector disengaged, and also showing a remotely-operated hook for disconnecting the electrical connector;

FIG. 3 is a front view of the removable assembly of the electrical connector;

FIG. 4 is a front view of the static assembly of the electrical connector, the assemblies of FIGS. 3 and 4 being shown in assembled relation in FIG. 1;

FIG. 5 is a perspective view of a jig which is adapted for the fabrication of the electrical connector;

FIG. 6 is a perspective view of a cap for protecting the removable assembly from acid sprays and submersions during decontamination;

FIG. 7 is a perspective view of a block used for aligning the electrical connector of the invention during fabrication;

FIG. 8 is a cross-sectional view of the sealing ring used in the electrical connector;

FIG. 9 is a diagrammatic perspective view of an alternate form of the electrical connector and locking mechanism therefor of the invention;

FIG. 10 is a rear view of the connector of FIG. 9 looking at the removable assembly;

FIG. 11 is a side view of the connection looking along line 11—11 with portions cut away;

FIG. 12 is a diagrammatic perspective view of a third and alternate form of the electrical connector and locking mechanism therefor of the invention;

FIG. 13 is a rear view of the connector of FIG. 12 looking at the removable assembly;

FIG. 14 is a perspective view of the V-shaped rail and static assembly in an alternate vertical form of the invention;

FIG. 15 is a perspective view of the removable assembly being inserted into the V-shaped rail and static assembly of the alternate vertical form of the invention;

FIG. 16 is an exploded cross-section view of the male and female receptacles with their respective surrounding cylindrical sections on the static and removable assemblies in vertical conformation; and FIG. 17 is a perspective view of a light box being inserted into a V-shape rail according to the invention.

DESCRIPTION OF THE INVENTION

The electrical connector of the invention shown in the drawings is generally designated by the numeral 5. The electrical connector 5 comprises a static assembly 7 which has at its rearward end a mounting plate 9 adapted to be mounted upon a support (not shown) by bolting or otherwise. Thus, the static assembly 7 will normally permanently remain in the hostile environment and provide a source of electricity.

The electrical connector 5 further comprises a removable assembly 11 which is adapted to be connected to and disconnected from the static assembly 7. The removable assembly 11 will electrically connect to equipment and be removed with such equipment for repair and maintenance.

The static assembly 7 and removable assembly 11 are carried upon a pair of longitudinally-extending, transversely-spaced, V-shaped rails 13 and 15, the static assembly 7 being fixedly connected to the rails 13 and 15 by means of transversely-extending bars 17 and 19. The removable assembly 11, on the other hand, is adapted to slide in the rails 13 and 15 on V-shaped glides 21 and 23 which fit into the rails 13 and 15. The V-shaped glides 21 and 23 are connected to the bottom of the removable aseembly 11 by means of transversely-extending bars 25 and 27. At the rearward end of the female assembly there is provided vertically-extending plates attached to the rear face of the female assembly 11, they being plates 29 and 31 which are connected to a rearwardly-extending lanyard 33, which is adapted to engage a remotely-operated hook 35 (FIG. 2) for purposes of disconnecting the removable assembly 11 from the static assembly 7.

The static assembly 7 comprises a male receptacle 37 which is of conventional design and includes four prongs 39. The male receptacle 37 is screwed or otherwise fixedly applied to a flat plate 41 which is attached to a casing 43. The casing 43 is generally box-shaped and the plate 41 is applied as a cap to the casing 43, as particularly shown in FIGS. 1 and 2 of the drawings. The casing 43, like other exposed parts of the electrical connector 5, is made of stainless steel or other special metals to withstand a hostile environment external to the connector 5.

A cylindrical, rearwardly-extending section 44 surrounds the male receptacle 37 to provide waterproof protection and serves to align the static assembly 7 and removable assembly 11. The cylindrical section 44 is fixedly connected to the plate 41 by welding or otherwise. The male receptacle 37 connects to a pigtail 45, through a waterproof connection 47, which is located on a side of the casing 43. The connection 47 is of standard design and construction, which is readily available in the marketplace. The pigtail 45 connects to a source of electricity.

The removable assembly 11 is generally of the same construction as the static assembly 7 and includes a female receptacle which comprises a female socket 49 having recesses 51 for receiving the prongs 39 of the male receptacle 37. The female receptacle is bolted or otherwise connected to a plate 53 which is, in turn, fixedly connected to a second casing 55, which is also generally like the casing 43 and box-shaped. For purposes of convenience and handling, the top of the casing 55 is connected to a carrying lanyard 57 which extends upwardly from the top of the removable assembly 11.

The female receptacle is within a forwardly-extending protective cylindrical section 59, as is particularly shown in FIG. 2 of the drawings. The cylindrical section 59 is proportioned to fit within the cylindrical section 44 when the male receptacle 37 and female socket 49 are engaged. The cylindrical section 59 is connected to the plate 53 at the front end of the casing 55 of the removable assembly 11 by welding or otherwise. The forward end of the cylindrical section 59 is provided with a groove 61 in which is disposed a rubber sealing ring 62 which is V-shaped in cross-section. The groove and rubber sealing ring or V-ring 62 are proportioned so as to provide a waterproof seal between the cylindrical section 59 and the cylindrical section 44. The front edge of the cylindrical section 59 is beveled to ease fitting into the cooperating cylindrical section 44.

The precise alignment of both assemblies 7 and 11 is a key feature of this invention and should be effected without the guide pins of the prior art which caused binding. Close alignment is required for mating the small prongs 39 and recesses 51 of the receptacle 37 and socket 49, respectively, of the connector 5. This precise alignment is accomplished by two successive steps during the mating action. First, the V-shaped guide rails 13 and 15 serve as a course guide, which is sufficiently accurate to always cause the beveled end of the cylindrical section 59 of the removable assembly 11 to always fit into, or mate with the larger cylincrical section 44 of the static assembly 7. Second, precise alignment results when the cylindrical section 59 mates with the cylindrical section 44 by means of the sealing ring 62 and its V-shaped cross-section. See FIGS. 8. and 10. The sealing ring 62 is fabricated from a soft synthetic rubber, such as a Viton co-polymer available from DuPont. The sealing ring 62 more concentrically and precisely aligns the assemblies 7 and 11 so there is matching of the small electrical prongs 39 and recesses 51. The sealing action of the V-ring comes from the bending action of the ring's flexible sides rather than compression with the result it is able to seal over a much greater tolerance range with little, if any, increase in disengagement force, and with no attendant loss of sealing integrity. It should be noted that O-rings conventionally available do not generally provide the desired action and their use is to be avoided.

In summary, the cylindrical section 44 and the cylindrical section 59 must be very carefully aligned so as to facilitate the interconnection and disconnection of the male receptacle 37 and female socket 49.

The removable assembly 11 is also provided with a connection to an electrical wire 63 which extends into the casing by means of a waterproof connection 64. The electrical wire 63, of course, connects to the female socket 49 and also connects to equipment (not shown).

In order to provide protection against earthquakes and the like, a lock 65 is provided as a part of the removable assembly 11. The lock 65 is adapted to protect against disconnection in the vertical and/or horizontal directions and comprises separate locking devices. In order to lock the electrical connector 5 in place in the horizontal direction, a generally L-shaped locking pin 67 is provided for purposes of extending through a hole 69 located near the rear end of the rail 13 (FIG. 1). The L-shaped locking pin 67 has a handle 68 at its upper end by reason of its shape so that the locking pin 67 can be lifted out of the hole 69 and rotated by the hook 35. The locking pin 67 has a stop 71 attached at the top of the locking pin 67 to limit downward movement of the pin. The locking pin 67 further extends through a channel section 73 connected to the plate 29, the channel section 73 extending the vertical length of the plate. Thus, the locking pin 67 moves vertically into and out of the hole 69 to hold the removable assembly 11 against disengagement. When the stop 71 rests on the top of the casing 55, it is disengaged from the hole 69 but the stop 71 is rotated by means of the handle 68 so that the stop drops onto the upper end of the channel section 73 and the locking pin 67 drops into the hole 69.

The rearwardmost crossbar at the bottom of the removable assembly, the bar being identified by numeral 25, extends transversely outwardly of the removable assembly 11 so as to be in position to engage a clip 77, and thereby hold the removable assembly against vertical displacement when the receptacle 37 and socket 49 are interconnected. The clip 77 is connected to a transversely-extending crosspiece 79 which is fixedly attached to the bottom of the rails 13 and 15 and which extends outwardly of the rails so as to be in position to engage the clip 77. When the removable assembly 11 is engaged with the static assembly 7, the clip 77 holds the assemblies against vertical shock, as shown in FIG. 1.

In order to assemble the sections in proper relationship, a jig is provided as shown in FIG. 5, the jig being generally identified by the numeral 81. The jig comprises an upstanding plate 83 with an aligning arm 85 attached at its upper end. At the lower end of the plate 83, there is provided a pair of V-shaped forwardly-extending aligning supports 87 and 89 which, at their outer end, are connected together by means of a crosspiece 91. The crosspiece 91 is welded or otherwise fixedly connected to the V-shaped supports 87 and 89. In assembling the electrical connector 5 of the invention, the jig shown in FIG. 5 is used to align the static assembly 7 and removable assembly 11.

The removable assembly 11 and static assembly 7 can be provided with a cap 93, shown generally in FIG. 6, which includes a plate 95 to which is attached a surrounding cylindrical section 97. The cap 93 can be conveniently applied to an assembly by a remote manipulator upon disconnection in a contaminated area, so that there is minimum exposure from subsequent decontamination sprays and the like.

In FIG. 7, there is illustrated a block 99 which is used for precise aligning and positioning of the cylindrical sections 44 and 59 on their respective plates 41 and 53. The plates 41 and 53 are drilled to provide openings (not shown) for receiving the receptacle 37 and socket 49. The block 99 includes a nub 101 proportioned to fit the opening and to tightly fit within a cylindrical section 44 or 59 so that, when the block 99 is in place, the cylindrical section 44 or 59 can be accurately welded onto the plates 41 or 53. The electrical connector 5 of the invention provides a simple device for connecting and disconnecting without binding by means of a remotely-operated manipulator which can readily pull apart the static assembly 7 and removable assembly 11.

FIG. 9 illustrates the invention in alternate form. The electrical connector 105 comprises a removable assembly 111 and a static assembly 107. The static assembly 107 and removable assembly 111 are carried on a longitudinally-extending V-shaped rail 113. The static assembly 107 is supported across the V-shaped rail 113 by its casing 143 which is affixed to the rail as by welding. The removable assembly 111 is adapted to slide on rail 113 on a V-shaped glide 121 which glide fits into rail 113. Both the static assembly and the removable assembly include surrounding box like casings 143 and 155. The casing 155 of the removable assembly forms part of glide 121 or is affixed to the glide as by welding. As with the connector 5 in FIGS. 1–3, the static assembly 107 of connector 105 has a male receptacle with prongs which receptacle is fixed applied to a flat plate 141 attached to the casing of the static assembly.

The removable assembly 111 is generally of the same construction as the static assembly 107 and includes a female receptacle which comprises a female socket having recesses for receiving the prongs of the male receptacle. The female receptacle is bolted or otherwise connected to a plate 153 which is, in turn, fixedly connected to the second casing 155, which is also generally like the casing 143 and box-shaped. For purposes of convenience and handling, the top of the casing 155 is connected to a carrying lanyard 157 which extends upwardly from the top of the removable assembly 111; a rear extending lanyard extends from casing 155 to move the movable assembly from the static assembly.

As with the embodiment shown in FIGS. 1–3, the female receptacle is within a forwardly-extending protective cylindrical section. The cylindrical section surrounding the female receptacle is proportioned to fit within the cylindrical section surrounding the male receptacle when the male receptacle and female socket are engaged. The cylindrical section surrounding the female receptacle is connected to the plate 153 at the front end of the casing 155 of the removable assembly 111 by welding or otherwise. The forward end of the cylindrical section surrounding the female receptacle is provided with a groove in which is disposed a rubber sealing ring which is V-shaped in cross-section. The groove and rubber sealing ring are proportioned so as to provide a waterproof seal between the cylindrical section surrounding the female receptacle and the cylindrical section surrounding the male receptacle. The front edge of the cylindrical section surrounding the female receptacle is beveled to ease fitting into the cooperating cylindrical section surrounding the male receptacle.

The glide 121 supporting the casing 155 of the removable assembly has slider guides 177 and 179 extending transversely across the open V of the glide 121 at each end of the removable assembly which assembly extends over the open V of the rail 113 and glide 121. The slider glides fit into the open V of the glide and have central openings or holes 181 to accommodate a bolt 130 with a head 132, the bolt threaded at one end with threads 167 to threadably engage weld nut 185 affixed as by welding in rail 113 at a position between the static and removable assemblies. The bolt has collar 168 which is affixed to the bolt, as by welding. The bolt is oriented along the longitudinal axis of rail 113 within the V of the glide extending through holes 181 in the slider glides 177 and 179 with the threaded end of the bolt pointed toward the static assembly and aligned with weld nut 185. Collar 168 is adapted to abut the inside surfaces of the slider guides 177 and 179; collar 168 holding the removable assembly in place when the bolt threadably engages nut 185 by abutting the collar 168 against slider guide 179 which in turn abuts nut 185; collar 168 also retains the bolt under the removable assembly by abutting guide 177 when the bolt is unscrewed from the nut. Preferably the collar is spaced along the bolt such that the threaded portion of the bolt is not permitted to withdraw from the hole of slider glide 177 as the head 132 of bolt 130 is pulled along the rail away from the static assembly.

The bolt as a part of a locking mechanism provides an exceptionally strong means for locking the static and removable assemblies together and is especially adaptable for use in nuclear plants where robotic equipment includes impact wrenches which can easily thread and unthread the bolt with the weld nut 185. To make an electrical connection, the removable assembly is pushed or pulled toward the static assembly to engage the static assembly and the prongs and sockets. The bolt 130 is held in place under the removable assembly by collar 168 and extends through the holes 181 in slider guides 177 and 179. When the bolt is threadably engaged with nut 185 collar 168 pushes the slider guide and the removable assembly affixed thereto toward the weld nut 185 and the static assembly. When the bolt is fully threaded into the weld nut, collar 168 compressively holds the slider guide and removable assembly onto the weld nut for a secure electrical assembly.

FIGS. 12 and 13 illustrate the invention and bolt locking mechanism in still another alternate form. The static assembly 207 and removable assembly 211 are rotated 90° from the forms heretofore described such that the respective corners of their casings 243 and 255 slidably engage a V-shaped rail 213 (see FIG. 13). Two slider guides 277 and 279 with holes 281 are affixed to the side of the removable assembly with a bolt 230 extending through holes 281 in the slider guides. The bolt has a head 232 and threads at 267, the bolt being aligned to threadably engage weld nut 285 affixed to the static assembly. The static assembly has a bumper block 217 to consistently position the bolt relative to the static and removable assemblies when the bolt is threadably engaged with the nut to lockably engage the two assemblies. A collar 268 is affixed to the bolt between slider guides 277 and 279. The slider guides 277 and 279 being spaced at a distance wherein if the bolt is unthreaded and withdrawn from nut 285 and is pulled back therefrom, the bolt will not be pulled from either slider guides on the removable assembly, but rather the collar will abuttingly engage slide guide 277, the bolt being prevented from being removed from either slider guide by the collar on the bolt. The assemblies are locked together by the bolt 230 when the bolt threadably engages nut 285 and collar 268 abuts slider guide 279 to compressively hold the removable assembly in place and in abutting relationship with the static assembly 207.

FIGS. 14 through 16 illustrate the invention in still another alternate vertical form. The static assembly 307 has a vertical cylindrical section 344 extending therefrom surrounding male receptacle 337 which includes cylindrical wall 338 surrounding vertical prongs 339. The static assembly is affixed to vertical V-shaped rail 313. The interior wall 345 of cylindrical section 344 has a slot 346 extending about one half the height of cylindrical section 344.

Referring to FIG. 15, removable assembly 355 has an upwardly extending top lanyard 333 and a downward extending cylindrical section 359 which surrounds the cylindrical female socket 349 (See FIG. 16).

The vertical form of the connector has three important interacting features which aids efficient and easy connection of the removable assembly with the static assembly. The upwardly extending lanyard 333 of the removable assembly 311 is affixed to the top wall 356 of the box-shaped casing 355 at points 357 and 358 which lie on a line where the weight of the removable assembly is unevenly distributed such that when removable assembly is held vertically from the lanyard, the assembly tips downwardly on one side and upwardly on the other. Most preferably in the vertical form of the connector, the corner 375 of casing 355 acts as a glide which engages rail 313 and the lanyard is affixed to the top wall of the casing to one side of a theoretical vertical plane which equally divides the removable assembly diagonally across. By so affixing the lanyard, as the removable assembly is held vertically from the lanyard as seen in FIG. 15, corner 375 of the removable assembly will tip up and corner 376 will tip down as a result of the unequal weight distribution resulting from the placement of the lanyard. This will bring the lower portion of corner 375 into engagement with the V-shaped rail 313 and which engagement aids alignment of cylindrical section 359 of the removable assembly with cylindrical section 344 of the static assembly. Without such weight distribution and construction, engagement of the removable assembly with the static assembly would be difficult using a robotic control from the vertical.

To further aid in connecting the two assemblies from the vertical, the removable assembly is weighted such that the interior wall of the cylindrical section of the removable assembly, because of its own weight from the vertical, will frictionally engage sealing ring 362 in groove 361 in the cylindrical section 359 of the removable assembly and prongs 339 of the male receptacle 337 will engage female socket 349. As a result, a robot arm, which engages the lanyard and which moves horizontally, can position the removable assembly on the rail 313; and the weight of the assembly with little or no additional force can connect the removable assembly. To further aid in this feature of the invention, slot 346 is cut in the interior wall of cylindrical section 344 and extends from the top of that cylindrical section facing the removable assembly to about one-half way down the cylindrical section. The slot permits air to be released and escape from the interior of the cylindrical sections of the removable and static assemblies as they are being interconnected. This alleviates any resistance caused by air being compressed as the cylinders are sealingly engaged at sealing ring 362. When the two assemblies are connected, the slot terminates just above the sealing ring 362, as at 361 in FIG. 16, such that the cylindrical section 359 is sealingly engaged inside the cylindrical section 344 of the static assembly.

FIG. 17 illustrates an alternate form and application of the invention as an electrical connection for light box 405 which consists of a removable box assembly 411 with a clear wall or lens 412, light 410 and a V-shaped glide 421 on wall 414 which is opposite clear wall 412. Lanyard 433 is mounted on the top wall 418 of the box assembly such that the weight of the box assembly is unevenly distributed when held from the vertical. More particulary, the lanyard placed on the top wall 418 of the box assembly 411 is placed on a line parallel to wall 414 which is closer to wall 414 than clear wall 412. As a result the top of removable box assembly will tip forward and the bottom of glide 421 will engage the V-shaped rail mounted on wall 416. This will provide for alignment of the female connector 449 (shown in outline) with the static male assembly 407 mounted on floor 418. As a result the light box can be easily interconnected with an electrical current source.

It should be understood that while certain preferred embodiments of the present invention have been illustrated and described, various modifications thereof will become apparent to those skilled in the art. Accordingly, the scope of the present invention should be defined by the appended claims and equivalents thereof.

Various features of the invention are set forth in the following claims.

What is claimed is:

1. An electrical connector particularly adapted for remotely operated use and alignment of male and female parts of the connector in hostile environments, comprising, in combination, a static assembly and a removable assembly, one assembly having a first cylindrical section, the other assembly having a second cylindrical section, said cylindrical sections being juxtaposed for alignment and interengagement with one another, one of said assemblies being attached to an open guide rail at the bottom thereof which extends from said one assembly, the other of said assemblies having a glide at the bottom thereof for sliding on said rail, the guide rail having a longitudinal axis and being adapted for engagement with the glide from a direction generally normal to the longitudinal axis of the guide rail for sliding interengagement of the guide rail with the glide and the assemblies for coarse alignment of said cylindrical sections, one of said assemblies having a male receptacle mounted thereon and one of said assemblies having a female receptacle mounted thereon, said first cylindrical section surrounding said male receptacle and said second cylindrical section surrounding said female receptacle, one of said cylindrical sections being proportioned to fit within the other to provide a second alignment to align the male and female receptacles subsequent to the coarse alignment, and a sealing ring on one of said cylindrical sections, said sealing ring proportioned to further align the receptacles after the second alignment and to sealingly engage the other cylindrical section.

2. An electrical connector in accordance with claim 1 further including a lanyard on said other assembly for connecting said assemblies and wherein said static assembly has said male receptacle mounted thereon with said first cylindrical section surrounding said male receptacle, said removable assembly has said glide and said female receptacle with said second cylindrical section surrounding said female receptacle, said female receptacle comprising a female socket, said second cylindrical section having a beveled edge around its circumference to align the cylindrical sections and receptacles and to facilitate a sealing engagement of the first cylindrical section with second cylindrical section.

3. An electrical connector in accordance with claim 1 further including a lanyard on said other assembly for connecting said assemblies and a locking means to restrict movement of said other assembly having a glide on said rail, said locking means comprising a vertically movable locking pin carried on said other assembly and engageable with a hole in said rail when said assemblies are interconnected, thereby restricting horzontal movement of said other assembly.

4. An electrical connector in accordance with claim 1 further including locking means to restrict movement of said other assembly on said rail, said locking means comprising a removable clip connected between said other assembly and said rail to restrict movement in the vertical direction.

5. An electrical connector in accordance with claim 1 further including locking means to restrict movement of said movable assembly on said rail in the vertical and horizontal directions, said locking means comprising a vertically movable locking pin carried on said other assembly and engageable with a hole in said rail when said assemblies are interconnected, and a clip connected between said other assembly and said rail to restrain vertical movement of said other assembly.

6. An electrical connector in accordance with claim 1 wherein said guide rail is vertical, the static assembly having a vertically extending cylindrical section, wherein said removal assembly includes said glide and a lanyard, said lanyard being affixed to the removable assembly such that the weight of the removable assembly tips the glide on the removable assembly for interengagement with said vertical rail and the cylindrical section on the removable section being positioned to move downwardly and interengage the vertically extending cylindrical section.

7. An electrical connector in accordance with claim 1 further comprising a cover for one of said cylindrical sections.

8. An electrical connector in accordance with claim 1 wherein said sealing ring is fabricated from a soft synthetic rubber, said sealing ring having a V-shaped cross-section with converging sides and a head pointing toward the juxtaposed assembly, said sides bending toward one another as the head moves toward the juxtaposed assembly.

9. An electrical connector in accordance with claim 8 wherein one of said cylindrical sections surrounds the other cylindrical section, said surrounding cylindrical section having an interior wall with a slot, said surrounded cylindrical section having an exterior wall fitted with the sealing ring, said slot permitting an escape of air during the sealing engagement of the cylindrical sections.

10. An electrical connector in accordance with claim 1 further including a locking means to restrict movement of said other assembly having a glide on said rail, said locking means comprising:

a bolt having threads at one end thereof and at least one collar affixed thereto;

at least one slider guide affixed to said other assembly said guide having a hole therethrough said bolt extending through said hole;

a nut adapted to threadably engage said bolt, said nut being held in a fixed location relative to said other assembly so that when the bolt threadably engages the nut said assemblies are held in fixed relation in respect to one another.

11. An electrical connector in accordance with claim 10 further including a lanyard on said other assembly.

12. An electrical connector in accordance with claim 10 further including a lanyard on said other assembly.

13. An electrical connector in accordance with claim 10 wherein said other assembly is said removable assembly with two slider guides mounted thereon and said nut is mounted on said static assembly.

14. An electrical connector in accordance with claim 13 wherein said bolt has two collars affixed thereto between said slider guides such that the collars abuttingly engage the slider guides when the bolt is moved axially along said rail.

15. An electrical connector in accordance with claim 10 wherein said other assembly is said removable assembly with two slider guides mounted thereon and said nut is mounted on said rail.

16. An electrical connector in accordance with claim 15 wherein said bolt has two collars affixed thereto between said slider guides such that the collars abuttingly engage the slider guides when the bolt is moved axially along said rail.

17. An electrical connector in accordance with claim 16 further comprising a cover for one of said cylindrical sections.

* * * * *